US005880682A

United States Patent [19]

Soulliard et al.

[11] Patent Number: 5,880,682

[45] Date of Patent: Mar. 9, 1999

[54] TRAFFIC CONTROL SYSTEM AND METHOD OF OPERATION

[75] Inventors: Charles J. Soulliard; Herschel W. Ward, both of Tucson; Stephen M. Matacia, Phoeniz, all of Ariz.

[73] Assignee: Midian Electronics, Inc., Tucson, Ariz.

[21] Appl. No.: 993,626

[22] Filed: Dec. 18, 1997

[51] Int. Cl.[6] ..... G08G 1/095

[52] U.S. Cl. ..... 340/907; 340/933; 340/941; 324/207.13; 324/244

[58] Field of Search ..... 340/907, 910, 340/917, 933, 935, 941; 324/207.13, 207.14, 207.15, 207.22, 207.26, 244, 247, 258

[56] References Cited

U.S. PATENT DOCUMENTS 5,530,349 6/1996 Lopez et al. ..... 324/254

*Primary Examiner*—Jeffery A. Hofsass
*Assistant Examiner*—Daryl C. Pope
*Attorney, Agent, or Firm*—Harold Gell

[57] ABSTRACT

A vehicle detector comprising a flux gate magnetometer with vertical and horizontal sensing coils is positioned within a roadway. The ambient levels of the earth's magnetic field as sensed by the magnetometer are used to establish reference levels and deviations therefrom are evaluated by a microprocessor which produces a vehicle arrived signal when the vertical component of sensed perturbations exceed a threshold and in an alternate mode when either vertical or horizontal levels exceed threshold values. Both vertical and horizontal levels must fall below threshold levels to determine a departure in either mode. Vehicle arrival and departure events are encoded as NRZ data packets which are transmitted by an edge-fired antenna as FM modulated signals. A remote multi-channel receiver capable of responding to a plurality of magnetometer modulated FM transmitters processes the received data and provides signals that are used by traffic signal controlling computers.

20 Claims, 10 Drawing Sheets

JOINS Fig. 8

TRAFFIC CONTROL SYSTEM AND METHOD OF OPERATION

FIELD OF THE INVENTION

A traffic signal controlling system including a microprocessor responsive to a plurality of magnetometer modulated FM transmitters via a multi-channel receiver performs operational steps wherein the output of each magnetometer is controlled by an associated microprocessor to sense vehicle arrival and departure according to a preselected agenda.

BACKGROUND OF THE INVENTION

The ever increasing traffic burden born by existing roadways has necessitated traffic regulating signal devices such as intelligent traffic control systems which are responsive to current traffic flow patterns. Historically such control systems involve embedded wires in the roadway such as described, for example, in U.S. Pat. No. 3,863,206 for "Digital Vehicle Detector". Such systems sense the passage of vehicles so that the signalling devices will give priority to the more heavily travelled roadways at intersections. Unfortunately such devices require wires spanning vehicle lanes. These spans of wire are subject to wear and if buried, the vibrations and shifting of the roadway caused by vehicle traffic and thermal expansion and therefor have a high failure rate. When a wire fails, the roadway must be dug up so that a replacement wire may be buried. Digging up the roadway may consist of simple narrow slit trenches a few inches wide but nevertheless the process interrupts traffic flow for hours or even days when complications arise. Furthermore, such devices only sense traffic waiting or crossing an intersection and therefore are useful only to cycle a traffic control device at intersections of infrequently traveled roadways with busy arteries whereby the traffic flow through the busy artery is not interrupted unless a vehicle is waiting in the less traveled roadway.

Prior attempts have been made to utilize vehicle sensing magnetometers to control traffic signalling devices such as the various systems developed by the Naval Surface Weapons Center of Silver Spring, Md. and described in their final report FHWA-RD-79-89 of October 1978 which is incorporated herein by reference. These devices proved successful in controlled experiments but failed to provide dependable service in an actual working environment. Therefore it is a primary objective of the present invention to provide a magnetometer means for sensing vehicular traffic combined with a computer control means for regulating traffic signalling devices which will operate reliably under the ambient conditions found in all traffic control situations.

OBJECTIVES OF THE INVENTION

It is a primary objective of the present invention to provide a vehicle sensing, traffic signal controlling means wherein the vehicle sensing device is mounted within a cylindrical housing containing a battery power source that may easily be installed and removed in a roadway without disturbing the roadway surface.

An objective inherent in the primary objective of the invention is the improvement of the battery-powered vehicle detector disclosed in the U.S. Department of Transportation report, "Development of a Self-Powered Vehicle Detector, Report No. FHWA-RD-79-89", the revised printing thereof "DOT-1-84-13" which is incorporated herein by reference. The major improvements thereto including lane isolation through interactive sensitivity and selection control between vertical and horizontal field sensors and a more efficient and environment tolerant transmitter antenna system.

It is a further objective of the present invention to provide a vehicle sensing, traffic signal controlling means capable of detecting and differentiating traffic in adjacent, same direction parallel roadways.

Another objective of the present invention is to provide a method for sensing vehicular traffic with the aid of a plurality of magnetometers combined with transmitters capable of signalling a receiving station having a plurality of channels and microprocessor controlling circuitry whereby traffic signalling or controlling devices may be operated according to predetermined algorithms based on the most expedient means for allowing traffic through the intersection and further based on current and prior vehicular movements.

A further objective is to provide a magnetometer vehicle sensing means coupled to a traffic control system wherein horizontal sensing is suppressed relative to vertical sensing and is unsuppressed as a function of vehicle detection by the vertical sensing means.

Another objective of the present invention is to provide a magnetometer vehicle sensing means coupled to a traffic controlling receiving system via a spiral antenna driven by the magnetometer circuitry via a low impedance circuit compensator for mismatch in a transmission medium due to varying soil on the asphalt conditions.

A still further objective is to provide a buried magnetometer vehicle sensing system coupled to a traffic control system via a buried end fire antenna.

SUMMARY OF THE INVENTION

The invention is comprised of a plurality of vehicle sensors, each of which includes a magnetometer, a magnetometer driven FM transmitter, a battery, and a spiral antenna in an independent housing. The housings are adapted to be removably placed in cylindrical holes within or adjacent to a roadway. Preferably the housings are plastic pipes with a closed bottom and a removable stainless steel top and the receiving hole is dimensioned so the top of a housing buried therein will be below the road surface. Each vehicle sensor includes a microprocessor for controlling the response sensitivity to the vertical and horizontal magnetic fields of the magnetometer according to operational parameters as a function of hardwire jumpers and what is sensed in the vertical field in one embodiment and the vertical or horizontal field in an alternate embodiment.

A multi-channel receiver is responsive to the magnetometer modulated transmitters of the vehicle sensors. The receiver provides data to a dedicated microprocessor that evaluates the received data and provides control outputs to traffic regulating signal devices.

DETAILED DESCRIPTION OF THE INVENTION

Figure 1:
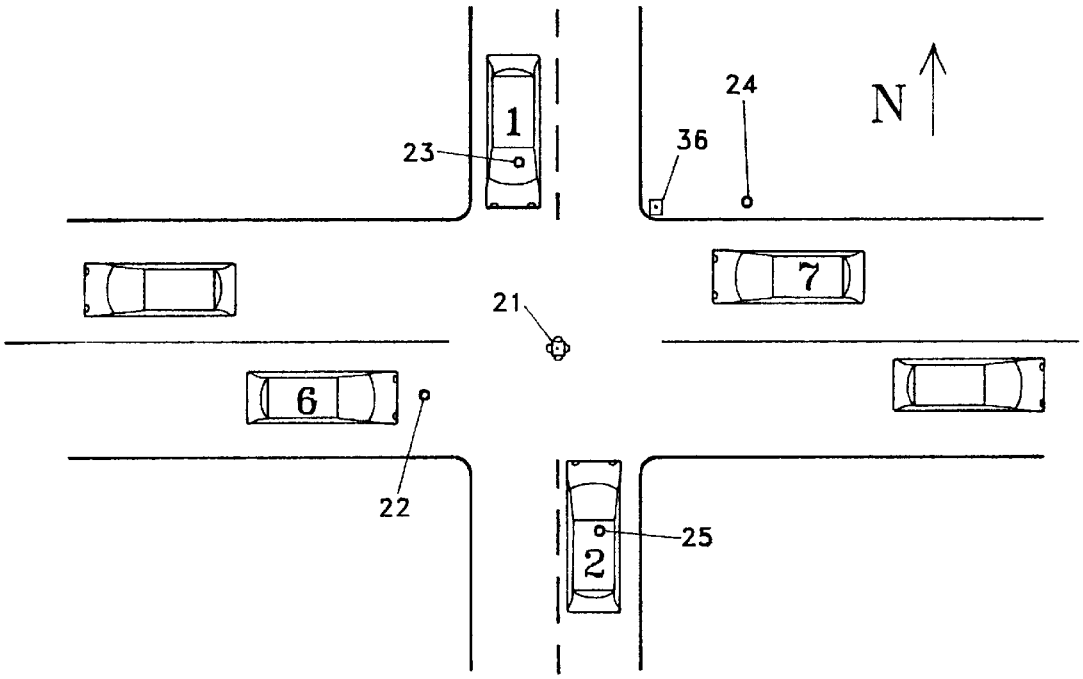
FIG. 1 is a plan view of a typical four-way intersection using four magnetometer sensing transmitters to control a traffic light.

FIG. 1 is a typical four-way intersection employing a traffic control signalling light 21 capable of providing straight through and turn control functions for each lane. Magnetometer based vehicle sensors 22, 23, 24 and 25 detect the presence of vehicles in their respective lanes and transmit the data to a four channel receiver 36 which is located adjacent to a roadway at the intersection and preferably within the traffic light control system housing. The four channel receiver supplies the received data to the traffic light control system which typically is a computer controlled switching means operating an algorithm which processes the data from the receiver.

In FIG. 1 vehicles 1 and 2 are sitting over vehicle sensors, magnetometer/transmitters 23 and 25, respectively which transmit data via the receiver 36 to the traffic control computer so that the algorithm will know how long each of the vehicles, 1 and 2, have been sitting at the intersection. Vehicle sensors, magnetometer/transmitters 22 and 24, sense the passage of traffic in easterly and westerly directions respectively to provide data via the receiver 36 to the traffic control computer which will indicate the volume and speed of the traffic passing through the intersection so that the controlling algorithm can appropriately regulate left turn traffic from either the east or west lanes or stop traffic and allow a north/south traffic flow. The traffic controlling device 21 provides straight through, stop and left turn signal functions for eastbound, westbound, northbound and southbound traffic under control of the traffic control computer switching means which is responsive to the four channel receiver which is disclosed in detail in FIGS. 10, 11 and 12.

Figure 2:
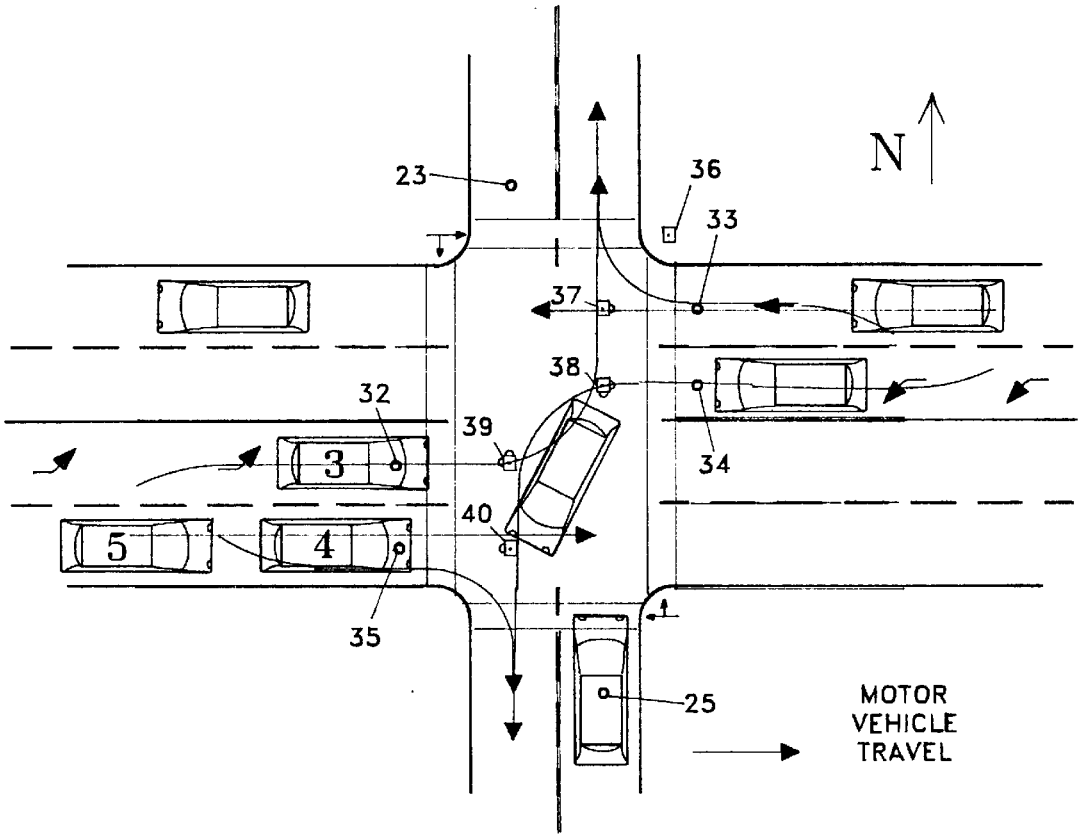
FIG. 2 is a plan view of an intersection wherein the major roadway includes left turn control functions.

FIG. 2 is exemplary of the invention utilized to control an intersection between a multi-lane major thoroughfare and a secondary road. In this set up, vehicle sensors, magnetometer/transmitters 33 and 35, monitor through traffic and right turn traffic onto the secondary road and magnetometer/transmitters 32 and 34 monitor traffic in the left turn lanes of the east/west major thoroughfare. Four vehicle sensors transmit data to receiver 36 located at the roadside. This data is processed by a computer which utilizes an algorithm to regulate the operation of signal lights 37, 38, 39 and 40. In this arrangement, signal light 37 controls westbound traffic, signal light 38 controls left turn traffic from the westbound lane and through traffic in a northbound direction. Signal light 39 controls left bound traffic from the eastbound lane and through traffic in the southbound lane. Signal light 40 controls through traffic in the eastbound lane. In such situations, secondary road north/south lanes have no effect on the traffic controlling algorithm.

In an alternate scenario for FIG. 2, vehicle sensors 33 and 35 are replaced by vehicle sensors 23 and 25 to monitor the north/south traffic. The east/west through traffic flows uninterrupted until a left turn or north/south traffic presence is sensed.

Figure 3:
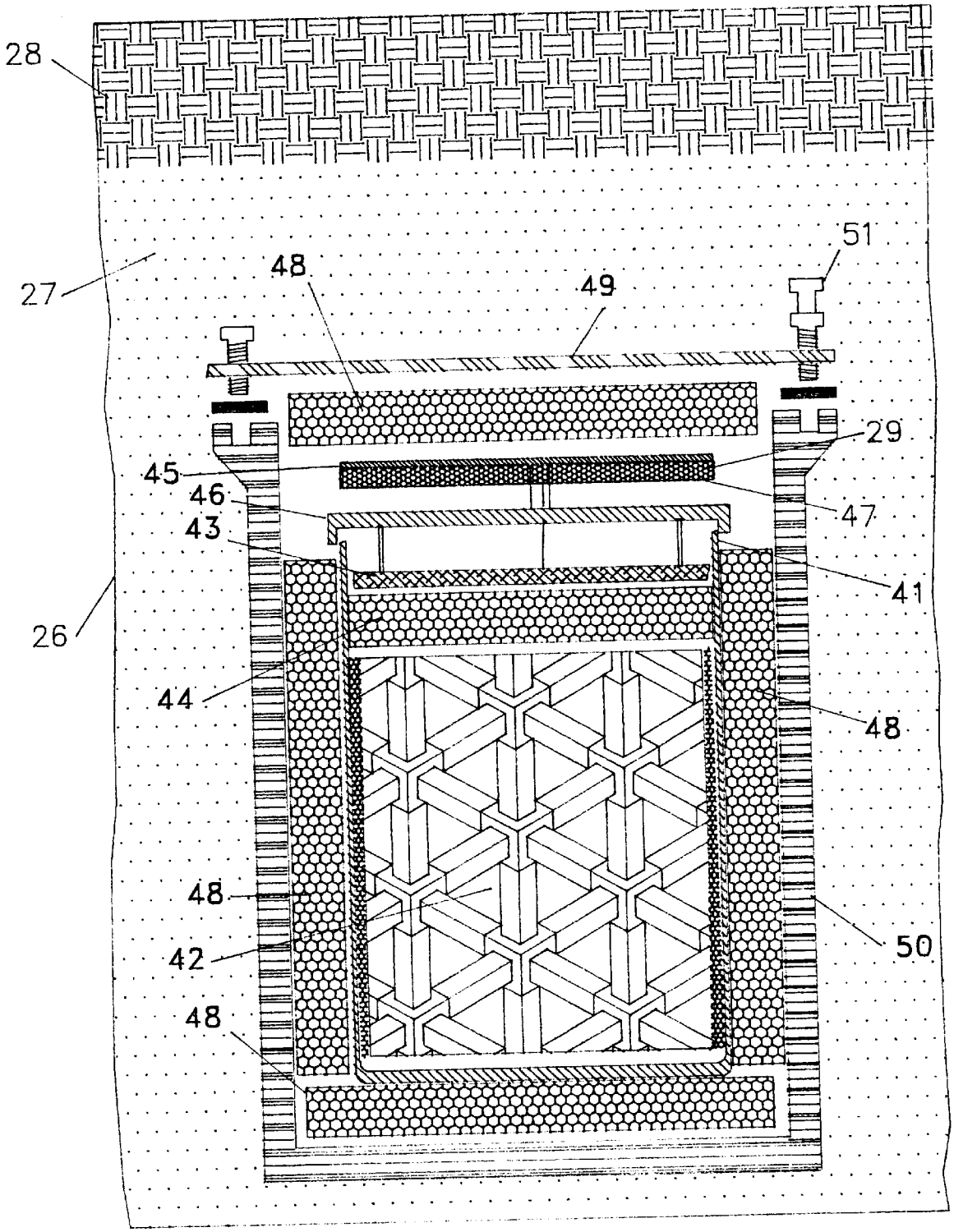
FIG. 3 is a side phantom view of a vehicle sensor positioned within an underground casing.

FIG. 3 is an exploded cut-away side view of a vehicle sensor positioned in its underground hole. In a preferred embodiment, the vehicle sensor is comprised of an aluminum canister 41 approximately 3½ inches in diameter. The space within the canister is occupied by a replaceable, foam wrapped battery 42 and printed circuit boards 43 which are isolated from the battery by a foam disk 44 to provide insulation and shock absorption. The printed circuit boards 43 include the transmitter circuitry as well as the coils forming the magnetometer. The canister is sealed by a top 46 which has a descending lip that fits tightly over the open top end of the canister, compressing foam disk 44 via spacers between the top and printed circuit board 43 to securely hold the battery 42 in place.

The transmitter output is coupled to an electrically short planar spiral antenna 45. The radiating element may be a heavy gauge wire but for ease of manufacture it is a printed foil in the preferred embodiment. The foil configuration is depicted in plan view in FIG. 4. Connections between the transmitter on the circuit boards 43 of FIG. 3 and the antenna 45 are via a coaxial cable which passes through the aluminum canister top 46. The supporting substrate for the printed foil radiating element 45 is secured by a double sided adhesive coated foam layer 29 to, and thereby spaced from, a printed circuit board 47 which serves as an antenna ground plane.

The sealed canister 41 and antenna 45 are surrounded by shock absorbing foam and placed within an electrically non-conducting, non-magnetic, closed bottom, tubular housing 50, such as a plastic pipe with an end cap forming the bottom. The housing is sealed by an electrically conducting, non-magnetic stainless steel plate 49 which is secured by bolts, one of which has a second head 51 that may be grasped by a hammer claw to facilitate lifting the housing in and out of a hole provide for it.

The conductive top plate 49 and ground plane 47 cooperate with the spiral antenna element 45 to create an edge-fired antenna array.

To install a vehicle sensor assembly, a hole, 26 of FIG. 3, a few inches larger in diameter and deeper than the height of the housing 50 and stainless steel plate 49 is dug in the roadway. The assembled sensor assembly housing 50 is placed in the hole and covered with sand 27 to within 3 to 4 inches of the roadway surface. The hole 26 is then filled flush to the roadway surface with asphalt 28 to provide a smooth in-the-roadway installation which allows removal of the vehicle sensor assembly for maintenance and battery replacement.

Figure 8:
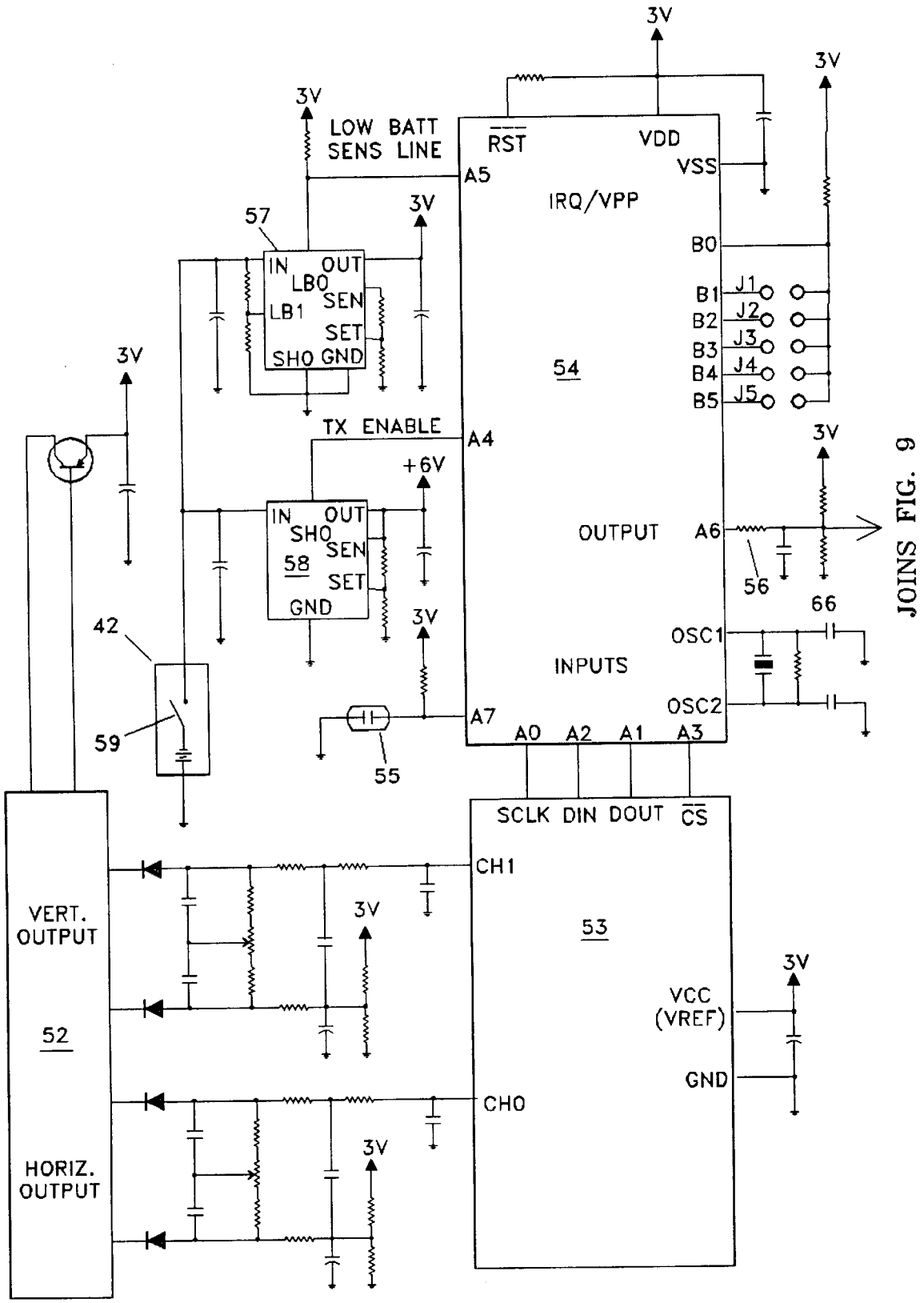
FIG. 8 is a schematic diagram of the magnetometer driving, sensing and coding circuitry.

The magnetometer sensing coil is a dual axis, flux gate magnetometer identified as 52 in FIG. 8. There are two secondary windings, one to measure the vertical component of the earth's magnetic field and one to measure the horizontal component of the earth's magnetic field. Each of these windings is fed into each of two channel input ports on A/D converter, 53. In the preferred embodiment the A/D converter is a 12-bit converter such as an LTC1288. Its output is applied to an 8-bit microprocessor 54 which is a Motorola MC68HC705J1A in the preferred best mode embodiment.

The vehicle sensor generates an arrival or departure signal when the microprocessor 54 senses that a vehicle has perturbed the earth's magnetic field beyond or below different software threshold levels that can be selected by the vertical and horizontal sensitivity jumpers, J1, 2 and 3 illustrated on microprocessor 54 in FIG. 8. The actual value of the sensitivity thresholds can be changed to meet operational requirements from sensing bicycles to battle ships. Therefore the relative sensitivity threshold levels are presented in the following table where 8 represents the highest field strength threshold and 1 the lowest.

Sensitivity Table

| Setting | Jumpers J5 | J4 | J3 | J2 | J1 | Vertical Acquire | Vertical Release | Horizontal Acquire | Horizontal Release |
|---|---|---|---|---|---|---|---|---|---|
| 1 | n/a | n/a | out | out | out | 7 | 6 | No | 8 |
| 2 | n/a | n/a | out | out | in | 6 | 5 | No | 8 |
| 3 | n/a | n/a | out | in | out | 5 | 4 | No | 8 |
| 4 | n/a | n/a | out | in | in | 4 | 2 | No | 8 |
| 5 | n/a | n/a | in | out | out | 8 | 6 | No | 8 |
| 6 | n/a | n/a | in | out | in | 3 | 1 | No | 6 |
| 7 | n/a | n/a | in | in | out | 3 | 1 | 3 | 1 |
| 8 | n/a | n/a | in | in | in | 4 | 2 | 6 | 5 |
| 9 | in | out | n/a | n/a | n/a | Tone input for 15 seconds followed by 10 seconds of test code output, then repeat indefinitely. | | | |
| 10 | out | in | n/a | n/a | n/a | No vehicle departure codes are transmitted. | | | |
| 11 | out | out | n/a | n/a | n/a | Vehicle departure codes are transmitted. | | | |

The input/output registers of microprocessor 54 are memory strapped to provide the sensitivity functions of the above table.

The first setting requires no jumpers. It is the best setting for general center-lane use. This setting will rarely be falsed by a vehicle in an adjacent lane such as vehicles 3 and 4 of FIG. 2. Higher sensitivity settings (i.e., lower nano Tesla settings) may false on adjacent lanes or cause clustering problems at traffic lights. This is due to vehicles stopping too closely to each other, such as vehicles 4 and 5, which appear as one long vehicle to the magnetometer 52 of FIG. 8.

Settings 1 through 6 acquire only in the vertical axis. Once they are acquired on the vertical axis, the sensitivity is raised to prevent dropping out between axles. Furthermore, once vertical acquisition occurs, the horizontal axis is enabled, a further preventative against dropping out between axles. Both the vertical and horizontal axes must drop below their release thresholds to transmit a departure. This virtually eliminates multiple arrivals and departures on the same vehicle, clustering problems at traffic lights and adjacent lane falsing as experienced in earlier systems using single or dual axis magnetometers without changing threshold levels.

The 7 and 8 settings which employ threshold levels ranging from 1 to 6 allow for capture on either the vertical or horizontal axis. These two settings are useful in side shot curb mount installations such as 24 of FIG. 1.

Figure 6:
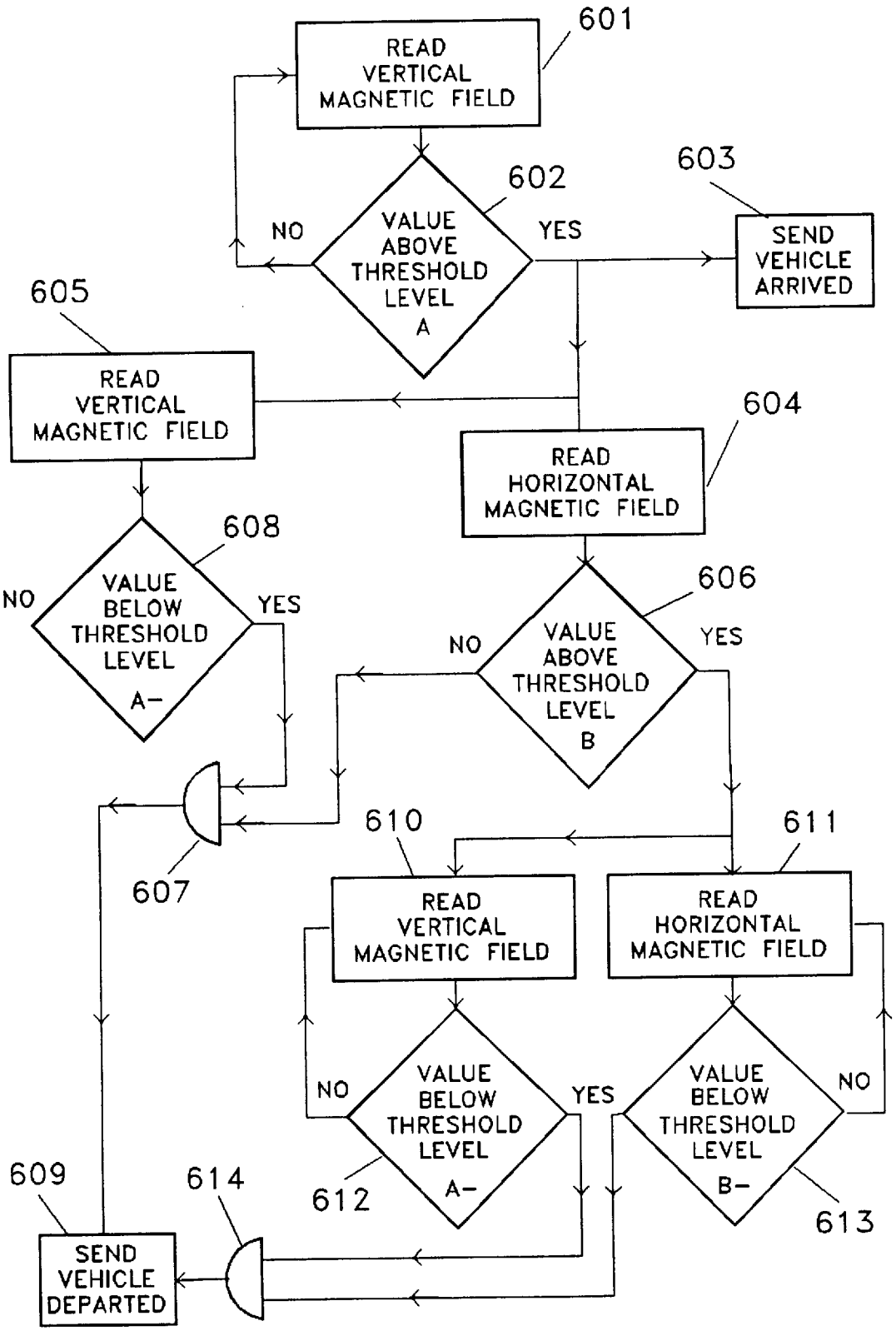
FIG. 6 is a logic flow diagram used in a typical installation using vertical sensing for arrival detection.

The logic employed in a typical application is illustrated in FIG. 6. Assuming the jumpers are arranged for setting 1 of the table, the "A" level in the FIG. 6 logic diagram represents a vertical magnetic field threshold of 7 and the "A-" 6. The "B" and "B-" thresholds are 8. In this scenario, as vehicle number 6 of FIG. 1 approaches the vehicle sensor 22, the vertical magnetic field is read, step 601 of FIG. 6. Vehicle number 6 has not entered the vertical field of vehicle sensor 22 sufficiently to cause the level to be above the threshold, 602, so the read vertical magnetic field function 601 continues.

In the case of vehicle 1 of FIG. 1, the vehicle has moved over vehicle sensor 23 and when its vertical magnetic field is read, 601, the value is found to be above the relative threshold level of 6, 602, and a "SEND VEHICLE ARRIVED" function 603 is activated whereby the transmitter associated with vehicle sensor 23 transmits a vehicle arrived signal to the traffic control device 36 controlling receiver. The YES output of step 602 also enables the read horizontal magnetic field function 604 and a read vertical magnetic is field function 605. If the horizontal magnetic field value is above threshold level "B", 606, in this case relative threshold level 8, both the vertical and horizontal magnetic fields are continually monitored. If the threshold level of the horizontal magnetic field is not reached 606, one input of two-input AND gate 607 is trued. In this situation when the vertical magnetic field drops below the preset threshold level, 608, the remaining input to the AND gate is trued, activating the vehicle departed function 609 and the transmitter sends an appropriate code to the receiver.

If the horizontal magnetic field value, as read in step 604 and evaluated in step 606, is above threshold level "B", then the vertical, 610, and horizontal, 611, magnetic fields are continually monitored. When both vertical and horizontal fields fall below their respective threshold levels, 612 and 613, a second AND gate 614 is trued and the "SEND VEHICLE DEPARTED" function 609 is activated. The foregoing creates a latching function whereby each axle of a vehicle will not create arrival and departure signals. When the arrival signal is created by the first axle, the horizontal field is above threshold level "B", preventing the transmission of a vehicle departed signal when the vertical level falls below threshold level "A-" as the first axle leaves the vehicle sensor as indicated by vehicle 2 which has partially passed over vehicle sensor 25 in FIG. 1. When the rear axle passes over the vehicle sensor, there is no effect because the vehicle departed signal has not reset the arrival mode 601. As the complete vehicle leaves the immediate vicinity of the vehicle sensor, both vertical and horizontal threshold levels fall below the critical values and a vehicle departed signal is initiated, resetting the arrival mode to step 601.

Figure 7:
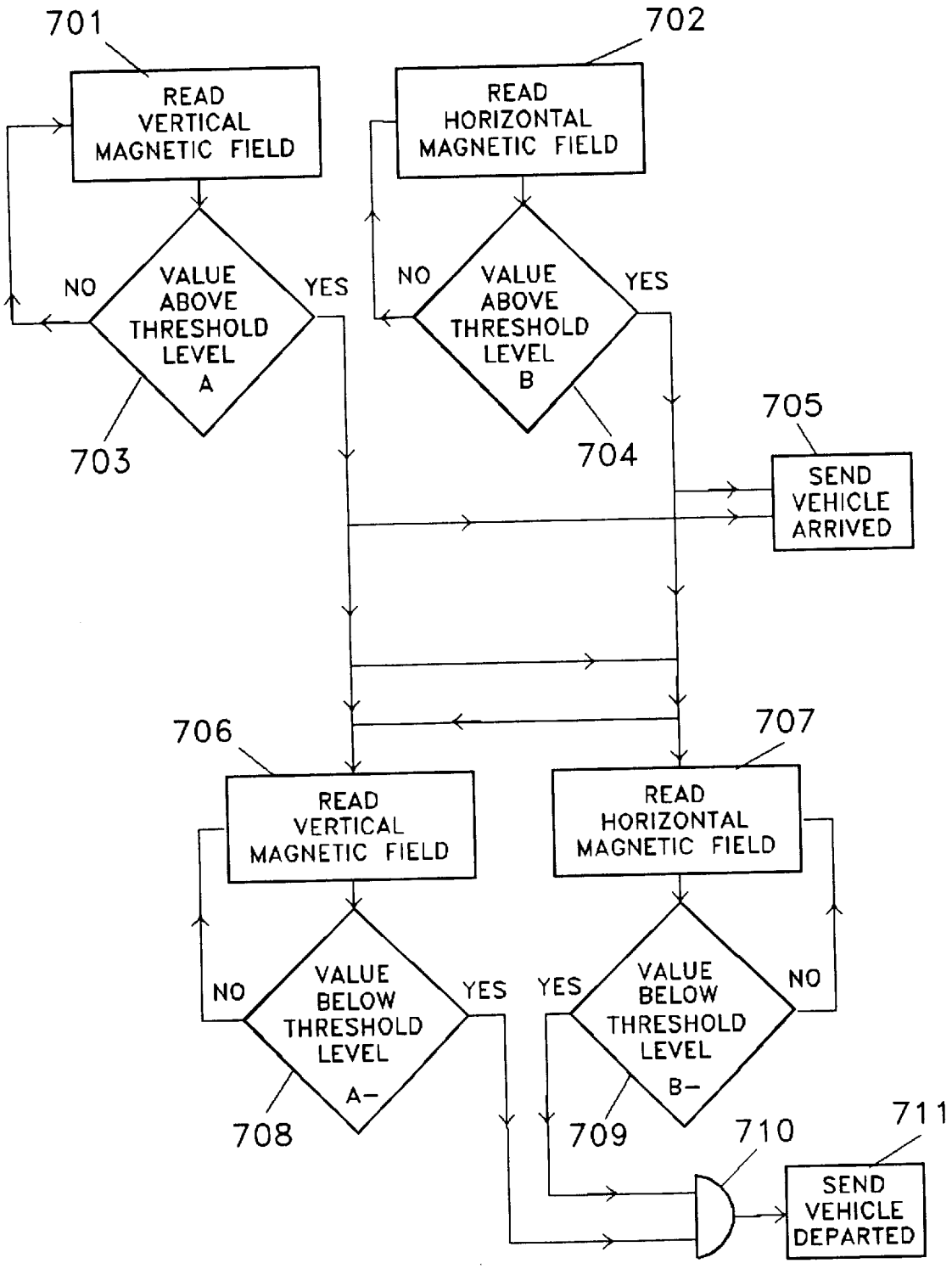
FIG. 7 is a logic flow diagram depicting the procedure used when horizontal sensing is used for arrival detection.

The preceding operational steps are performed when the jumpers are arranged according to settings 1 through 6 of the Sensitivity Table. When the jumpers are connected according to settings 7 or 8 of the Sensitivity Table, the operational steps performed by the system are according to the logic diagram presented by FIG. 7. In this scenario, both vertical and horizontal magnetic fields are monitored, 701 and 702. If either the vertical, 703, or horizontal, 704, values exceed their respective threshold levels, a "SEND VEHICLE ARRIVED" function 705 is initiated. Thus in areas where it is not desirable to use an in-the-roadway vehicle sensor, the vehicle sensor such as 24 of FIG. 1 may be placed adjacent to the roadbed. In this arrangement, as vehicle 7 draws adjacent to vehicle sensor 24, the horizontal magnetic field will exceed threshold level "B" causing the transmitter to initiate a vehicle arrived transmitter code. Using this arrangement with jumper settings 7 or 8, a single vehicle sensor may be positioned between two adjacent lanes and monitor vehicle traffic in both lanes. Because both vertical and horizontal magnetic field threshold level sensing is enabled, 701 and 702, a vehicle arrived signal 705 is transmitted whenever either the vertical or horizontal threshold level are exceeded. When a vehicle arrived signal is generated, the vertical and horizontal magnetic fields are monitored, 706 and 707, and when both fall below, their respective threshold levels, 708 and 709, the AND gate 710 is trued and a vehicle departure signal 711 is sent.

The arrangements and operational steps performed with respect to jumper settings 7 and 8 may be employed when a single vehicle sensor is utilized to sense vehicle arrival and departure traffic in a plurality of lanes or when it is not desirable to position a vehicle sensor within the roadbed.

The mercury tilt switch 55 of FIG. 8 is used to reset microprocessor 54 at the time that the vehicle sensor assembly is inserted into its in-the-roadbed hole. This activates the unit's initialization mode, whereby the microprocessor 54 of FIG. 8 generates some test tones and data packs to ensure that the receiving end is picking up the proper signal. It then measures the earth's magnetic field in the vertical and horizontal axes via the magnetometer and interprets the outputs of the magnetometer as ambient or zero, the levels from which the thresholds are measured, and saves the data in RAM, which takes less than a second. After installation, when the sensed magnetic fields fail to change for a predetermined time, the microprocessor 54 interprets the outputs of the magnetometer as ambient or zero and new levels from which the thresholds are measured are set and saved in RAM.

As previously described, the microprocessor has jumpers that allows for: selecting high or low sensitivities in the vertical and horizontal axes; transmitting or inhibiting vehicle departure signals and, placing the unit into test mode for tuning the radio transmitter.

Figure 9:
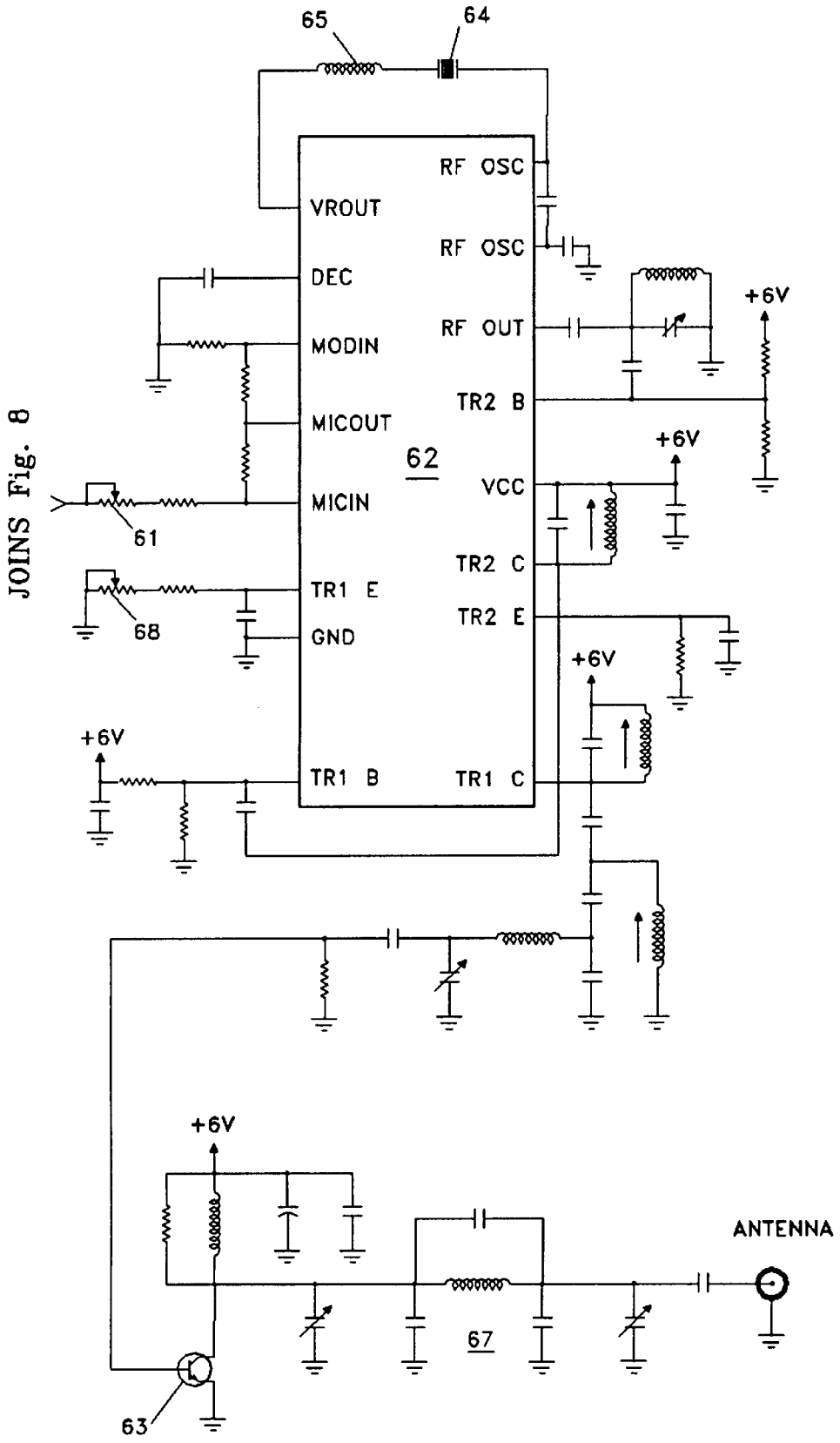
FIG. 9 is a schematic diagram of the transmitter.

The output of microprocessor 54 feeds a 390 baud NRZ signal through resistor 56 to deviation potentiometer 61 of FIG. 9 to the input of the lower power FM modulator 62. The signal output at Pin 4 directly modulates the transmitter 62 via Pin 3. In the preferred embodiment, the FM modulator 62 is a Motorola low power FM transmitter system MC2833D. It transmits the data packets illustrated in FIG. 5.

Three volts regulated DC power is supplied to the magnetometer coil 52, A/D converter 53, and microprocessor 54 by a type MAX666 programmable voltage regulator 57. The voltage regulator 57 also senses a low battery condition that is fed to microprocessor 54 so that the microprocessor can encode, through the transmitter, a low battery arrival or departure signal. Upon receiving this signal, the receiver activates the opto-isolator, 91 of FIG. 12, and output 129 on the connector, and lights a low battery LED on the front panel of the receiver. Voltage regulator 58 is another MAX666 programmable voltage regulator. It is programmed as a 6-volt regulator that provides power to the transmitter circuit when it is enabled by microprocessor 54.

The battery 42 consists of 8 alkaline D-cells for a 12-volt configuration with a 14 amp-hour rating. Approximately one third of its power is consumed by the magnetometer 52, A/D 53, and microprocessor 54 with the remainder being consumed by the modulator/transmitter 62 and power amplifier 63. There is a quarter amp resettable fuse, 59 of FIG. 8, internally mounted in the battery assembly 42 to protect it from a short circuit. The batteries are packaged in a neoprene container to provide thermal regulation and shock absorption, and also to prevent the battery pack from moving around inside the container as a result of external vibration.

The FM transmitter depicted by of FIG. 9 includes a temperature-compensated oscillator that incorporates NPO and N750 capacitors. These capacitors, in conjunction with the temperature curve of the fundamental AT cut crystal 64, limit temperature drift of the oscillator within FCC limits (−20° C. to +50° C.). The frequency of crystal 64 is fine adjusted by inductor 65. The FM modulator/transmitter 62 contains an operational amplifier circuit which works with input capacitor 66 and resistor 56 of FIG. 8 to act as a filter to prevent high frequency components above the data encoding rate from being transmitted by the modulator/transmitter. This is an FM modulator employing a non-return to zero (NRZ) data packet encoding scheme that is input to it from the microprocessor 54 via deviation adjustment potentiometer 61. Legal maximum modulation in this application is 5 kHz. Modulation is set to run approximately 4 kHz of deviation.

The FM modulator/transmitter 62 incorporates two RF transistors; each used as a doubler. They are connected in series to provide a X4 circuit which has one major advantage over an X2 circuit in that modulation level is reduced, thus reducing distortion. The inputs and outputs of the RF transistors incorporate Hi Q tuned circuits at their respective output frequencies to achieve maximum harmonic and spurious rejection while maintaining good bandpass quality. No multiplier retuning is required for change in channel frequency.

An M-derived pi network filter 67 process the output of the low impedance transmitter power amplifier 63 to insure a good match to the antenna because at this frequency the output impedance is nearly 50 Ohms. The pi network provides in excess of 50 db of harmonic rejection. This circuit withstands extreme mismatches at the antenna port due to varying soil types and conditions when the antenna is buried under ground. The circuit delivers 80 mW at approximately 35 mA of current consumption. The output of FM modulator/transmitter 62 is amplified to a nominal output of 80 mW by transistor 63. The power can be adjusted to meet the 100 mW legal maximum power output using the power set potentiometer 68. When using the transmitter within a few hundred feet of a traffic controlling receiver, power may be reduced to 50 mW to reduce battery consumption and extend battery life.

Figure 4:
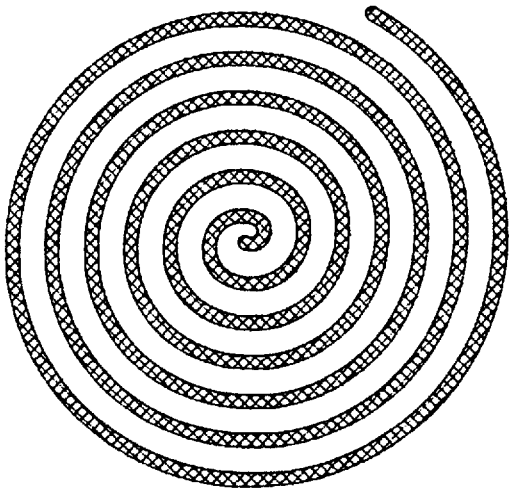
FIG. 4 is a top view illustrating the configuration of the spiral antenna.

The transmitting antenna, FIG. 4, is an electrically short planar spiral antenna whose length is approximately one-quarter wave length in order to obtain fundamental resonance. In this mode the radiation pattern is approximately that of a vertical monopole, i.e., doughnut shaped. The antenna, as previously discussed with respect to the cut-away view in FIG. 3, is comprised of a flat spiral element 45 secured above a ground plane 47 by a double sided adhesive foam spacer 29. Radiation is enhanced by the stainless steel plate 49 sealing the underground housing 50. The plate 49 is in contact with earth ground and with the antenna ground plane 47 converts the basic spiral antenna 45 into a 360 degree edge-fired antenna assembly. The antenna input is tapped into the spiral at a point that represents a 50 ohm impedance to match the output impedance of the transmitter.

The Q and the frequency of the antenna changes depending upon the hole in which it is buried. The transmitter power transistor 63 of FIG. 9 utilizes a low impedance output and is coupled to the antenna using an M-derived pi network filter 67 to help tolerate mismatches due to varying soil and asphalt conditions.

A typical intersection installation uses four (magnetometer/transmitters) as illustrated by FIGS. 1 and 2 with each tuned to a distinct channel detectable by a four channel receiver such as 36 of FIG. 2.

Figure 10:
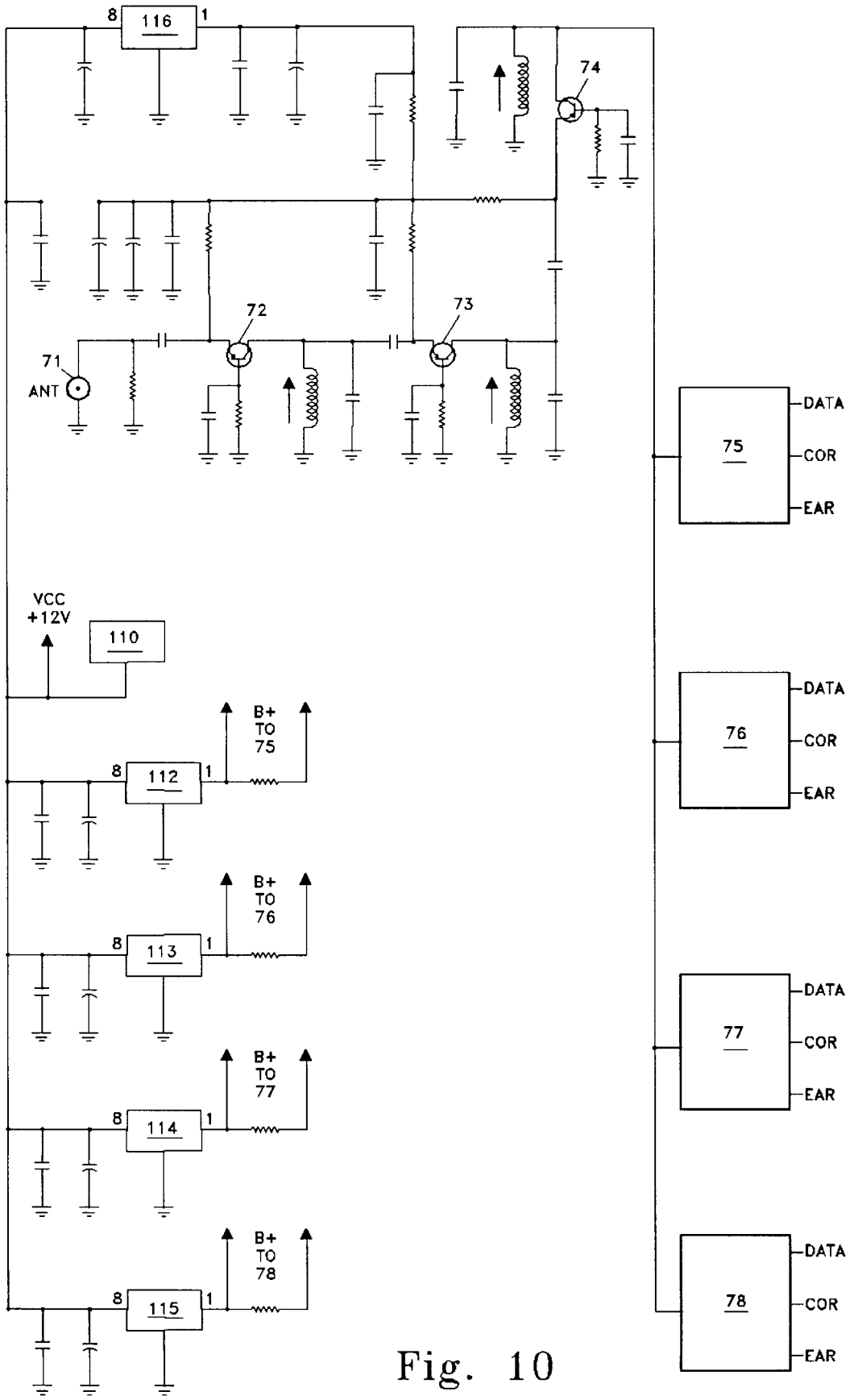
FIG. 10 is a diagram of a four channel receiver.

The incoming four channel signals are coupled from the receiving antenna 71 and filtered by an active filter network. This RF front end, FIG. 10, is a low gain amplifier employing three low-frequency cutoff transistors 72, 73 and 74, so that the unit is not vulnerable to oscillation. The FCC has allocated 20 channels for vehicle detector use (47.00–47.4 mHz). The front end is normally tuned at the center of this passband (47.2 mHz). The circuit is designed with a passband of 450 kHz and provides approximately 60 dB of rejection at the first L.O. image frequency (910 kHz away from the carrier). The RF front end simultaneously drives four extremely high gain IF system chips. This permits one antenna to drive four receivers 75, 76, 77 and 78 without having to use separate antennas or multi-couplers. The receivers have a 12 dB SINAD sensitivity of approximately 0.6 $\mu$V at the frequency closest to the center of the passband. The channels at the end of the passband are approximately 0.7 $\mu$V.

An AC/DC converter with a 12 volt DC output such as a 12 volt DC wall charger is used to power the receiver and decoder. The 12 volt supply, 110 of FIG. 10, has an MOV to protect it against transient spikes and a pi network filter to prevent RF noise from entering the regulator circuits. There are four identical 8 volt regulators 112, 113, 114 and 115, which power each of the receivers, 75, 76, 77 and 78. Separate regulators such as 78LO8s, are used to prevent interaction between each receiver channel. Another similar 8 volt regulator 116 is used to power the RF front end.

Figure 11:
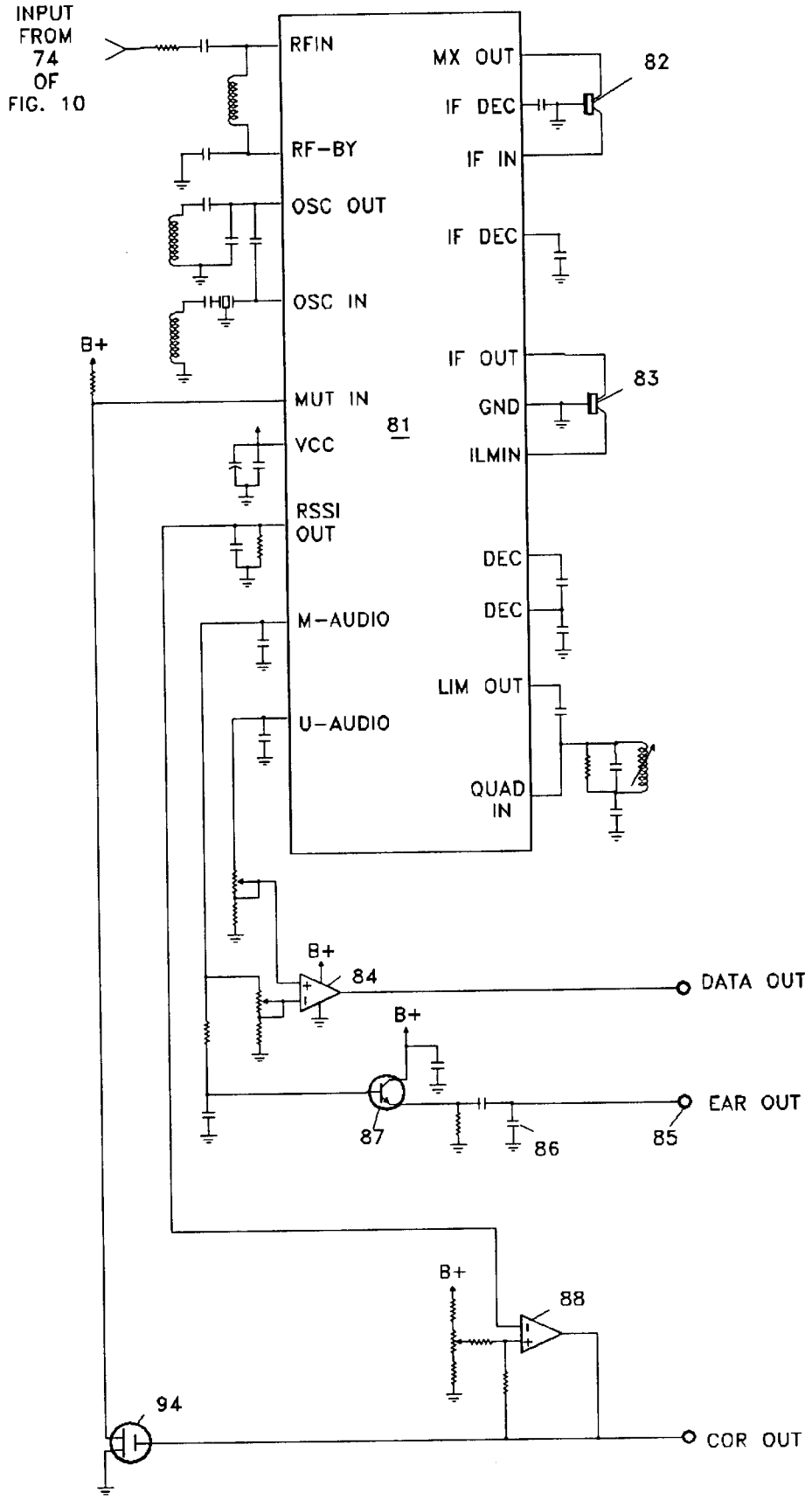
FIG. 11 is an exemplary schematic diagram of one channel of the four channel receiver.

To avoid repetition, only one receiver channel will be discussed. It is illustrated in FIG. 11. The receivers or more appropriately receiver channels, each incorporate a narrow band FM IF signal processing circuit 81 which in the preferred embodiment is a high performance low power mixer such as an FM IF system NE/SA605 produced by Philips Semiconductors. It contains a mixer, local oscillator, a 455 kHz amplifier, and a quadrature detector. Each receiver employs two 6 element 455 kHz ceramic filters 82 and 83, which are used to remove any unwanted signals from the output of the second mixer. The signal is then amplified, detected and separated into audio and RSSI components. The RSSI components are used to activate the squelch circuitry. An OP amp comparator 84 produces an NRZ data packet which is sent to the microprocessor, 92 and 93 of FIG. 12, for decoding.

Each of the receiver channels, 75 through 78, includes an earphone output jack 85 for monitoring channel traffic. Each earphone jack has a bypass capacitor 86 to keep RF from coming in on the earphone or speaker monitor lead. Each earphone jack is driven by a low impedance emitter follower buffer 87. Each of the receiver channels and the RF front end are constructed with a massive amount of ground shielding around them to prevent interaction among the units.

The squelch circuit utilizes the RSSI output to determine the presence of carrier. The RSSI is fed into the inverting pin of a comparator op amp 88. The comparator compares this signal to a reference signal on its positive non-inverting input, which is derived from the squelch pot divider 89. An FET 94 is connected to the output of the squelch comparator Schmidt trigger 88 to turn off the audio path inside the IF signal processing circuit 81. This eliminates constant IF noise from being presented to the decoder circuitry of FIG. 12 until a carrier has been detected to help prevent falsing on noise. The carrier (COR) signal must transition low at least 512 microseconds before the data start bit.

Figure 12:
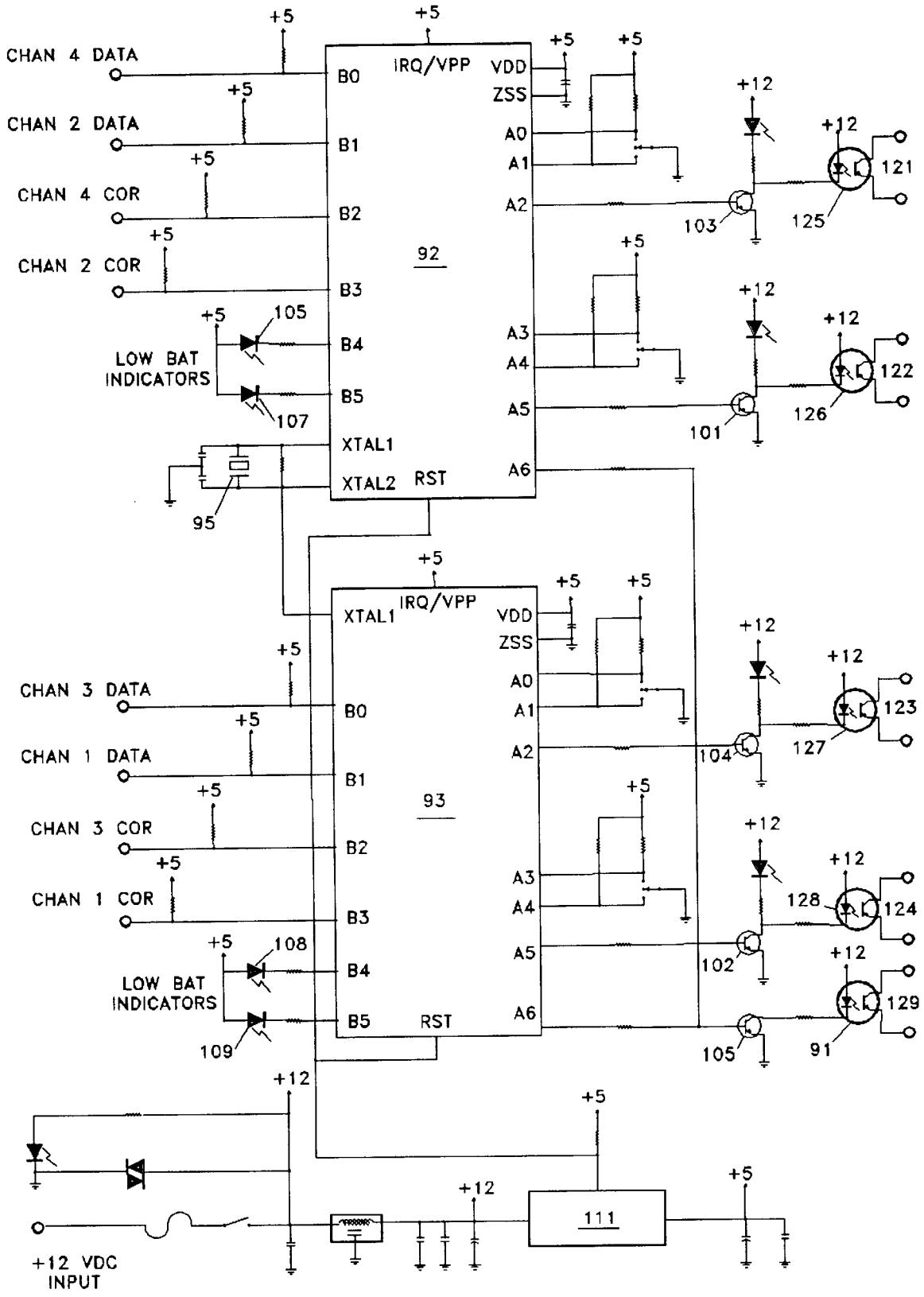
FIG. 12 is a schematic diagram of the receiver decoder.

The NRZ Microprocessor Data Packet Decoder is illustrated in FIG. 12. It comprises two dual radio channel NRZ data packet decoders, 92 and 93, which in the preferred embodiment are 68HC705J microprocessors produced by Motorola. A single 4 mHz xtal 95 is used to clock both microprocessors. The 390 baud error corrected data that is transmitted from the (magnetometer/vehicle sensors transmitter units) passes through the receiver, where it is recovered by the data comparators and the data out is fed to the B1 and B0 ports of decoders 92 and 93 respectively where the NRZ data packets are decoded.

Figure 5:
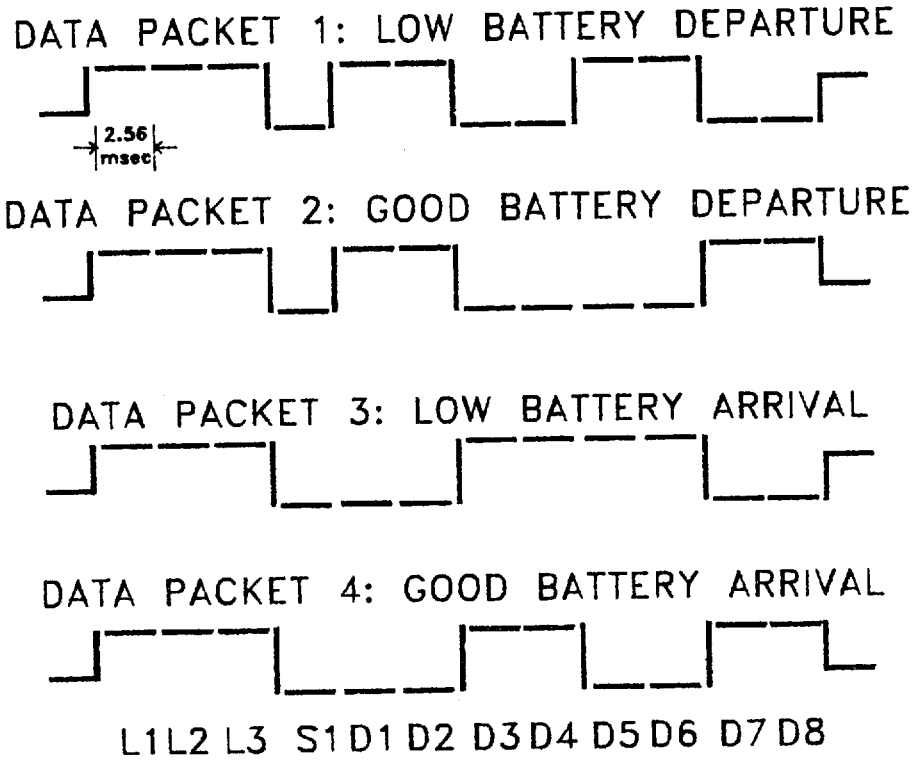
FIG. 5 graphically illustrates the data packet configurations.

As illustrated in FIG. 5, there are four data packets, one each for arrival/departure with good battery, and one each for arrival/departure with low battery.

Each microprocessor decoder runs a self-diagnostic routine at power-up and turns on the lamps and opto isolator outputs for two seconds. All outputs are then turned off, and normal operation commences. This also resets the low-battery LED indicator.

Data packets are only accepted if both an RF carrier and a valid synchronization data packet are present. The packets are handled as follows:

Vehicle Arrival

If the channel's mode switch is in the PRESENCE position, the opto-isolator output is turned on.

If in the PULSE position, the opto-isolator is turned on for 125 usec.

Vehicle Departure

Turn off the opto-isolator.

Battery Low

Turn on the associated battery-low lamp and the common low battery opto-isolator output. There is a bit that is appended to the arrival or departure packets to indicate a low battery.

Each channel has an associated output which runs to the front panel connectors. These outputs, 121, 122, 123, and 124, are the collector/emitter pairs from opto-isolators 125, 126, 127 and 128 respectively. If the emitter is grounded, the collector can operate in an open collector pull-down configuration. There is an identical output, 129, that acts as a common low-battery indication. It is driven by transistor 105 via opto-isolator 91. Transistors 101, 102, 103, and 104 form Darlington circuits that control the channel opto-isolators while simultaneously lighting the front panel pulse/presence sensor LEDs. Transistors 103 and 104 receive their signals from the A2 ports of their respective microprocessor decoder and 101 and 102 received their signals from the A5 ports. Transistor 105 receives its signal from the A6 port of both microprocessor decoders 92 and 93. The low battery LED indicators 106, 107, 108 and 109 are driven from the B4 and B5 ports of both microprocessor decoders.

A 5 volt regulator powers the microprocessor decoders 92 and 93. The output of the voltage regulator 111 is a low-voltage detector output that resets the microprocessor decoders 92 and 93 during power glitches or power failures. While preferred embodiments of this invention have been illustrated and described, variations and modifications may be apparent to those skilled in the art. Therefore, we do not wish to be limited thereto and ask that the scope and breadth of this invention be determined from the claims which follow rather than the above description.

What is claimed is:

1. A traffic control system, comprising:

A vehicle sensor comprising a flux gate magnetometer including vertical and horizontal sensing coils, a microprocessor controlled detector for evaluating vertical and horizontal perturbations sensed by said flux gate magnetometer, said microprocessor controlled detector configured to evaluate only vertical perturbations when considering a possible vehicle arrival and requiring both vertical and horizontal perturbations to be below predetermined levels to determine a departure and provide output signals reflecting its evaluation of vehicle arrival and departure, means for encoding said output signals as NRZ data packets, and an FM transmitter for transmitting said NRZ data packets; and a traffic control receiver comprising an FM receiver tuned to said FM transmitter, a microprocessor controlled decoder for said NRZ data packets transmitted by said FM transmitter and received by said FM receiver and output means for supplying to said traffic control signal means vehicle arrival and departure data decoded from said NRZ data packets by said microprocessor controlled decoder.

2. A traffic control system as defined by claim 1, further comprising:

a spiral antenna element driven by said FM transmitter;

a ground plane positioned under said spiral antenna element; and an electrically conductive, non-magnetic plate positioned over said spiral antenna element dimensioned relative to said spiral antenna element and said ground plane for creating an edge-fired antenna assembly.

3. A traffic control system as defined by claim 1, wherein said microprocessor controlled detector includes vertical and horizontal reference levels based on the quiescent levels of the earth's magnetic field in the vertical and horizontal axis as sensed by said flux gate magnetometer and the magnitude of said vertical and horizontal perturbations is gauged therefrom.

4. A traffic control system as defined by claim 3, comprising:

a housing containing said vehicle sensor;

a battery power source within said housing for powering said vehicle sensor; and a spiral antenna driven by said FM transmitter positioned on top of said housing.

5. A traffic control system as defined by claim 4, wherein said vehicle sensor is buried in the roadway, comprising:

means for compensating said spiral antenna for mismatch impedance created by the media in which said antenna is buried.

6. A traffic control system as defined by claim 5, further comprising a mercury switch for resetting said vertical and horizontal reference levels in response to the tilting motion encountered by the vehicle sensor at the time that it is buried.

7. A traffic control system as defined by claim 6, comprising:

a containment vessel with a closed end forming a bottom for enclosing said housing and said spiral antenna;

said containment vessel formed from an electrically non-conducting, non-magnetic material; and said containment vessel including a non-magnetic, electrically conductive top cover.

8. A traffic control system as defined by claim 7 wherein said spiral antenna is a quarter-wave length planar spiral antenna positioned below said non-magnetic, electrically conductive top cover operating in concert with a conductive ground plane positioned below said planar spiral antenna forming an edge-fired antenna assembly.

9. A traffic control system as defined by claim 8 comprising a plurality of said vehicle sensors, each operating at a different transmitter frequency and provided with one of said housings, antenna assemblies, and containment vessels; and said traffic control receiver comprises an FM receiver for each of said plurality of vehicle sensors.

10. A method for controlling vehicular traffic, including the steps of:

measuring the vertical magnetic field relative to a roadway with a magnetometer;

transmitting an arrival signal indicative of a vehicle arrival when said measured vertical magnetic field exceeds a predetermined threshold;

measuring the vertical and horizontal magnetic fields relative to a roadway with a magnetometer after said step of transmitting an arrival signal; and transmitting a departure signal indicative of a vehicle departure when said measured vertical and horizontal magnetic fields both are less than respective predetermined thresholds after said step of transmitting an arrival signal.

11. A method for controlling vehicular traffic as defined by claim 10, including the further steps of:

measuring the horizontal magnetic field relative to a roadway with a magnetometer concurrently with said initial step of measuring the vertical magnetic field; and transmitting said arrival signal indicative of a vehicle arrival when said measured horizontal magnetic field exceeds a predetermined threshold.

12. A traffic control system, comprising:

a vehicle sensor comprising a flux gate magnetometer including vertical and horizontal sensing coils, means for independently comparing perturbations of said vertical and horizontal sensing coils to predetermined respective arrival and departure threshold levels, means for providing a vehicle arrival signal when either of said vertical or horizontal perturbations exceed their respective predetermined arrival threshold level, means for producing a departure signal when said perturbations of said vertical and horizontal sensing coils are simultaneously below their respective predetermined departure threshold levels, and means for transmitting said arrival and departure signals;

a traffic control receiver tuned to said transmitter; and means for controlling traffic signalling means in response to said arrival and departure signals received by said receiver.

13. A traffic control system as defined by claim 12, wherein the magnitude of said vertical and horizontal arrival and departure threshold levels are relative to the quiescent levels of the earth's magnetic field in the respective vertical and horizontal axis as sensed by said flux gate magnetometer and the magnitude of said vertical and horizontal perturbations is gauged therefrom.

14. A traffic control system as defined by claim 13, further comprising:

a spiral antenna element driven by said transmitter;

a ground plane positioned under said spiral antenna element; and an electrically conductive, non-magnetic plate positioned over said spiral antenna element dimensioned relative to said spiral antenna element and said ground plane for creating an edge-fired antenna assembly.

15. A traffic control system as defined by claim 14, wherein said vehicle sensor is buried in the roadway, comprising:

loading means for said antenna for compensating for variations in mismatch impedance created by the media in which said antenna is buried.

16. A traffic control system as defined by claim 15, comprising:

a tubular aluminium housing containing said vehicle sensor; and said spiral antenna element is positioned on top of said tubular aluminium housing.

17. A traffic control system as defined by claim 16, further comprising a battery power source within said tubular aluminum housing for powering said vehicle sensor.

18. A traffic control system as defined by claim 17, further comprising a mercury switch for resetting said vertical and horizontal reference levels in response to the tilting motion encountered by the vehicle sensor at the time that it is buried.

19. A traffic control system as defined by claim 18 including a plurality of said vehicle sensors each operating at a different transmitter frequency.

20. A traffic control system as defined by claim 19 wherein said traffic control receiver comprises a receiver for each of said plurality of vehicle sensors.

* * * * *